US009644393B2

(12) United States Patent
McCue et al.

(10) Patent No.: US 9,644,393 B2
(45) Date of Patent: May 9, 2017

(54) IMPACT ABSORBING BARRIER

(71) Applicant: McCue Corporation, Peabody, MA (US)

(72) Inventors: David S. McCue, Manchester, MA (US); Thomas Ustach, Revere, MA (US); Timothy David Stratford, Milton Keynes (GB)

(73) Assignee: McCue Corporation, Peabody, MA (US)

( * ) Notice: Subject to any disclaimer, the term of this patent is extended or adjusted under 35 U.S.C. 154(b) by 126 days.

(21) Appl. No.: 14/658,901

(22) Filed: Mar. 16, 2015

(65) Prior Publication Data

US 2015/0259947 A1 Sep. 17, 2015

Related U.S. Application Data

(60) Provisional application No. 61/953,190, filed on Mar. 14, 2014, provisional application No. 61/953,219, filed on Mar. 14, 2014, provisional application No. 62/073,308, filed on Oct. 31, 2014, provisional application No. 62/107,108, filed on Jan. 23, 2015.

(51) Int. Cl.

| | |
|---|---|
| ***E04H 17/00*** | (2006.01) |
| ***E04H 17/18*** | (2006.01) |
| ***E01F 13/02*** | (2006.01) |
| *E04H 17/14* | (2006.01) |

(52) U.S. Cl.

CPC ..... *E04H 17/18* (2013.01); *E01F 13/022* (2013.01); *E04H 17/1413* (2013.01); *E04H 2017/1447* (2013.01); *E04H 2017/1452* (2013.01); *E04H 2017/1465* (2013.01)

(58) Field of Classification Search

CPC ..... E04H 17/16; E04H 17/18; E04H 17/24; E04H 2017/1447; E04H 2017/1452; E04H 2017/1465; E04H 17/1413; E04F 13/00; E01F 13/022

USPC ... 256/59, 65.01, 65.02, 65.07, 65.08, 65.11, 256/65.12, 65.13, 65.14, 69

See application file for complete search history.

(56) References Cited

U.S. PATENT DOCUMENTS 399,021 A * 3/1889 Dailey ..... E04H 17/10 256/48

5,503,496 A 4/1996 Voigt (Continued)

FOREIGN PATENT DOCUMENTS

GB 2512623 A * 10/2014 ..... E01F 13/02

OTHER PUBLICATIONS

International Search Report and Written Opinion, PCT Application No. PCT/US2015/020770, mailed Jun. 17, 2015 (6 pages).

*Primary Examiner* — Gregory Binda
*Assistant Examiner* — Nahid Amiri
(74) *Attorney, Agent, or Firm* — Occhiuti & Rohlicek LLP

(57) ABSTRACT

An impact absorbing barrier includes a plurality of posts and a plurality of rails. Each post of the plurality of posts includes an impact absorption mechanism. Each rail of the plurality of rails includes a first end coupled to a first post of the plurality of posts and a second end coupled to a second, different post of the plurality of posts. The coupling between the first end and the first post and the coupling between the second end and the second post cause at least some of a force of a collision on the first post to be transferred to the impact absorption mechanism of the second post.

21 Claims, 15 Drawing Sheets

(56) References Cited

U.S. PATENT DOCUMENTS

| | | | | |
|---|---|---|---|---|
| 5,649,396 | A | 7/1997 | Carr | |
| 5,891,534 | A | 4/1999 | Sabin et al. | |
| 6,141,928 | A * | 11/2000 | Platt | E04F 11/1812 256/65.14 |
| 6,290,212 | B1 * | 9/2001 | Bartel | E04F 11/181 256/59 |
| 7,188,457 | B1 * | 3/2007 | Halama | E04H 12/2253 248/501 |
| 7,523,715 | B2 * | 4/2009 | Mettler | A47B 23/042 116/63 R |
| 7,901,156 | B2 * | 3/2011 | McCue | E01F 9/627 404/10 |
| 8,282,083 | B1 * | 10/2012 | Poma | E04F 11/1812 256/59 |
| 8,444,343 | B2 * | 5/2013 | McCue | E01F 9/629 256/13.1 |
| 2004/0056241 | A1 * | 3/2004 | Calverley | E04F 11/1851 256/65.02 |
| 2005/0224777 | A1 * | 10/2005 | Terrels | E04F 11/181 256/65.01 |
| 2007/0158630 | A1 * | 7/2007 | Lo | F16B 7/0473 256/59 |
| 2008/0042116 | A1 * | 2/2008 | Buckley | E04H 17/1413 256/65.01 |
| 2013/0032773 | A1 | 2/2013 | Jette | |
| 2013/0186016 | A1 | 7/2013 | McCue et al. | |

* cited by examiner

IMPACT ABSORBING BARRIER

RELATED APPLICATIONS

This application claims priority to, and the benefit of, Provisional Application Ser. No. 61/953,190, filed Mar. 14, 2014, Provisional Application Ser. No. 61/953,219, filed Mar. 14, 2014, Provisional Application Ser. No. 62/073,308, filed Oct. 31, 2014, and Provisional Application Ser. No. 62/107,108, filed Jan. 23, 2015. All of the above applications are hereby entirely incorporated herein by reference.

FIELD OF THE INVENTION

This invention relates to an impact absorbing barrier for an industrial facility.

BACKGROUND

Warehouses, distributions centers, factories, and similar facilities often have large stock handling equipment such as fork trucks which frequently move stock into, out of, and around the facility. In some examples, facilities may have areas where stock handling equipment is prohibited from traveling. For example, stock handling equipment may be prohibited from traveling on pedestrian walkways or in close proximity to support columns or walls in the facility. Prohibited areas are generally designated to ensure the safety of the workers in the facility and the safety of the facility itself.

SUMMARY

As an operator navigates stock handling equipment through a facility, it is possible for the operator to inadvertently cause the stock handling equipment to dangerously encroach on areas where it is prohibited from traveling. In one example, the stock handling equipment may travel into a pedestrian walkway where it could potentially collide with and injure a pedestrian. In another example, the stock handling equipment may collide with an obstacle such as a support column or stock shelving, potentially causing damage to the obstacle and injuring any people around the obstacle.

In a general, an impact absorbing barrier includes a number of impact absorbing posts which are anchored into the ground. The posts are coupled together using rails, resulting in a fence-like barrier. Each of the impact absorbing posts is capable of absorbing the force of an impact and then returning to its original shape and position. The rails are tightly coupled to the impact absorbing posts in such a way that they resist removal from the posts and resist being pushed further into the posts.

In another general aspect, an impact absorbing barrier includes a number of posts, each including an impact absorption mechanism, a number of rails, each rail of the number of rails including a first end coupled to a first post of the number of posts, and a second end coupled to a second, different post of the number of posts. The coupling between the first end and the first post and the coupling between the second end and the second post cause at least some of a force of a collision on the first post to be transferred to the impact absorption mechanism of the second post.

Aspects may include one or more of the following features.

Each of the posts may include an outer shell with an inner core inserted therein. The outer shell may include a number of holes, each of the holes configured to receive an end of one of the rails. Each of the holes may open into a channel within the post. The outer shell of the post may include, on both sides of each of the holes, a recess in an outer surface of the outer shell. The recesses on the sides of the holes may define the channel within the post.

The coupling between the ends of a rail and post may be established by inserting a portion of an end of the rail through a hole and into a channel within the post. A fastener such as a bolt may then be inserted through a wall of the outer shell in a first recess on a first side of the hole, through the portion of the end of the rail within the channel, and through a wall of the outer shell in a second recess on a second side of the hole. The fastener may be disposed fully within the first and second recesses, without having any part of the fastener extending out of the recesses and beyond an outer diameter of the outer shell.

The inner core may be hollow and the impact absorption mechanism may be disposed within the hollow inner core. The outer shell may be rigidly affixed to the inner core. The outer shell may be rotatably affixed to the inner core. The inner core may have an oval shape. The inner core may include one or more ribs for contacting an inner surface of the outer shell. The inner core may include an alignment indicator for ensuring that the inner core is installed in proper alignment with other inner cores of the barrier.

Each of the rails may have a substantially oval shape. Each of the rails may be made of a plastic material. Each of the rails may be made of a metallic material. Each of the rails may be sized such that it extends between only two posts and does not extend fully through any post. Each of the rails may be removable from the barrier without requiring removal of any of the posts. A given rail may be removable by removing the fasteners from the ends of the rail, sliding one end of the rail further into one of the posts, causing the other end of the rail to emerge from the other of the posts.

The impact absorbing barrier may include one or more surface level barriers, each surface level barrier extending between the bottom ends of two of the posts. The surface level barriers may include two metallic end caps and a plastic rail extending between the two metallic end caps. Each of the metallic end caps may include a impact absorption mechanism. Each of the metallic end caps may abut a bottom end of a post and may be shaped to conform to an outer surface of a bottom end of the post.

In another general aspect, an impact absorbing barrier includes a plurality of posts, each including an impact absorption mechanism and a plurality of rails. Each rail of the plurality of rails includes a first end including a first latching mechanism for coupling the rail to a first post of the plurality of posts, and a second end including a second latching mechanism for coupling the rail to a second, different post of the plurality of posts. The first latching mechanism and the second latching mechanism cause at least some of a force of an impact on the first post to be transferred to the impact absorption mechanism of the second post.

Embodiments may have one or more of the following advantages.

Among other advantages, each post can be used as an end post, a middle post, or a corner post.

Due to the secure coupling of the rails to the posts, the entire pedestrian walkway barrier structure absorbs the force of collisions on any given part of the structure.

The pedestrian walkway barrier is modular and easy to repair and replace parts.

The pedestrian walkway barrier affords a number of dimensions of protection including wall protection, equipment protection, equipment operator protection, floor protection, and scratch/paint protection.

The pedestrian walkway barrier can absorb a collision with an 8000 lb piece of machinery moving at 3 mph without being damaged.

The pedestrian walkway barrier has easily visible hardware that does not present a snag hazard. This allows for both safe operation and simple installation, un-installation, and reconfiguration of the pedestrian walkway barrier.

The installation of the pedestrian walkway barrier is self teaching.

The pedestrian walkway barrier can operate in temperature ranges from 10 degrees Fahrenheit to 140 degrees Fahrenheit.

The pedestrian walkway barrier is highly visible.

The resulting barrier is an improvement over conventional barriers since it effectively protects an object or area while being less susceptible to damage caused by a collision with stock handling equipment. The barrier is also less likely to cause damage to stock handling equipment during a collision with stock handling equipment.

Due to the cumulative effect of the impact absorption capability of the posts and the tight coupling of the rails to the posts, a collision with one of the posts will have its force distributed from the post, through the rails, and into the other posts.

The dual snap button latching mechanism of the rails allows for easy removal and replacement of damaged rails.

Other features and advantages of the invention are apparent from the following description, and from the claims.

DESCRIPTION

Impact Absorbing Column Protection Barrier

Figure 1:
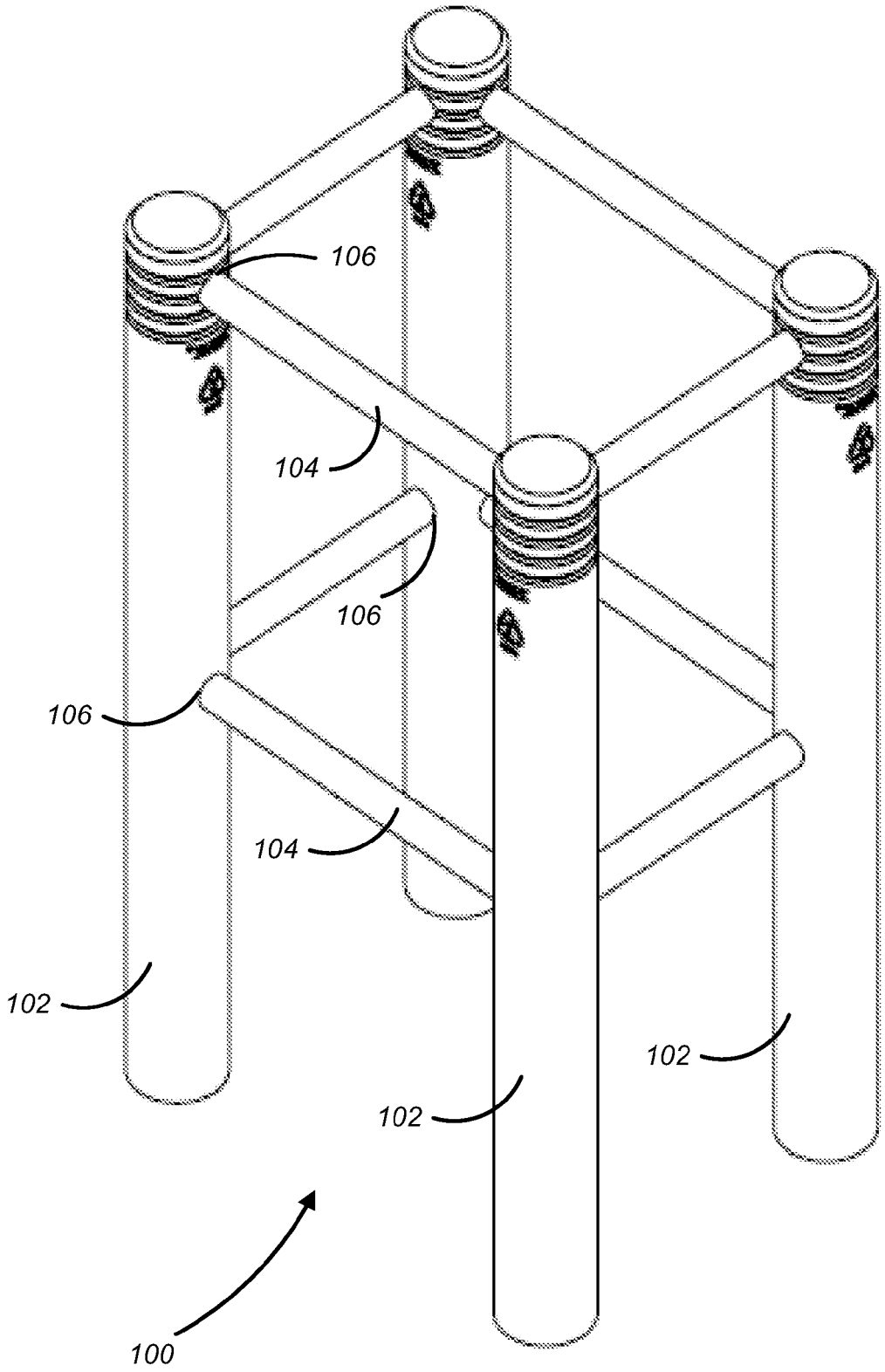
FIG. 1 is an impact absorbing column protection barrier.

Referring to FIG. 1, an impact absorbing column protection barrier 100 includes four impact absorbing posts 102 which are interconnected by a number of rails 104 to form a substantially square, fence-type barrier. In some examples, the barrier 100 is installed around a support column (not shown) for the purpose of protecting the support column from collisions with stock handling equipment.

Each of the impact absorbing posts 102 is fixed to the ground in a desired position by an anchoring mechanism (not shown in FIG. 1) and includes an impact absorption mechanism (also not shown in FIG. 1) which allows the post 102 to tilt to absorb the force of an impact and then return to its original position after the force of the impact has subsided. One example of an impact absorbing post suitable for use in the impact absorbing column protection barrier 100 is the post described in U.S. Pat. No. 8,444,343 titled "Impact-Absorbing Anchoring Assembly for Protective Barrier," which is incorporated herein by reference.

In this example, each of the impact absorbing posts 102 includes four holes 106, each configured to receive an end of one of the rails 104.

In some examples, each of the rails 104 is a hollow metal (e.g., steel) pipe which is cut to a custom size based on the desired dimensions of the barrier 100. Each rail 104 has two ends, one end configured to extend into one of the holes 106 in a first post 102 and another end configured to extend into another of the holes 106 in a second different post 102. Each end of each rail 104 includes a latching mechanism (not shown in FIG. 1) which maintains the position of the end of the rail 104 in the hole 106 of the post, including preventing the rail 104 from being unintentionally withdrawn from the hole 106 and preventing the rail 104 from unintentionally being inserted further into the hole 106.

Figure 2:
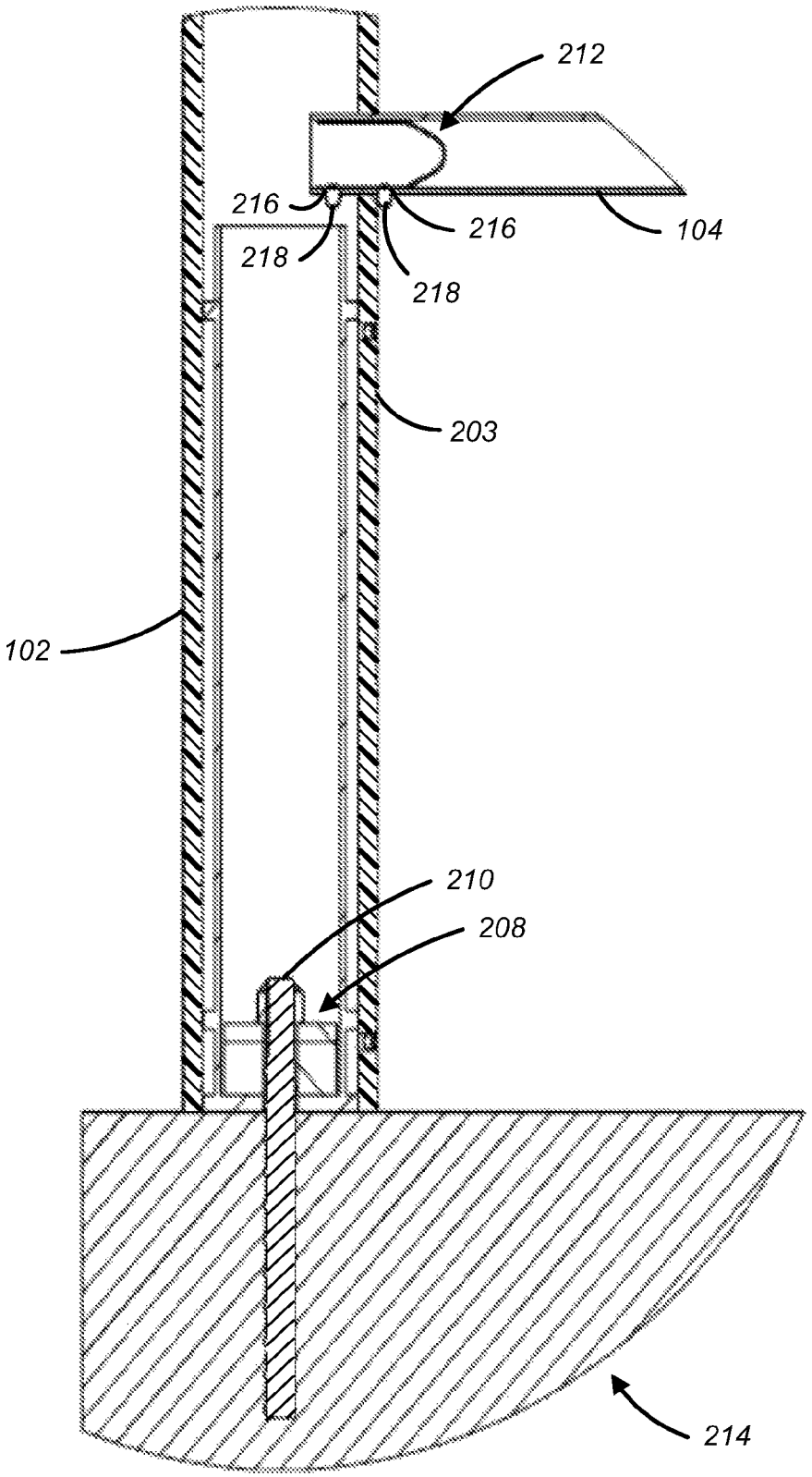
FIG. 2 is a cross sectional view of a portion of the barrier of FIG. 1.

Referring to FIG. 2, a cross-sectional view of one of the impact absorbing posts 102 shows that the post 102 is anchored to the ground 214 by inserting a fastener 210 (e.g., a bolt or piece of rebar) through an impacting absorbing mechanism 208 and into the ground 214. A detailed description of the impact absorbing mechanism 208 can be found in U.S. Pat. No. 8,444,343.

One of the rails 104 is inserted into one of the holes 106 in the post 102 with a latch mechanism 212 restricting the movement of the rail 104 in a lateral direction (i.e., restricting the movement of the cross bar 104 into and out of the post 102). In some examples, the latching mechanism 212 is a spring loaded "snap button" or "snap pin" fastener which includes two connected pins 218. To allow the pins 218 to emerge from the end of the rail 104, the end of the rail 104 includes two holes 216.

To install the rail 104, a technician manually compresses one of the pins 218 into its hole 216, causing the other pin to recede into its hole. The technician then inserts the rail 104 into the hole 106 in the post 102 such that one of the holes 216 of the rail 104 is on the inside of the post and the other hole 216 is on the outside of the post 102. Upon releasing the compressed pin 218, both pins 218 emerge from their respective holes 216 with one pin 218 disposed on the inside of the post 102 and the other pin 218 disposed on the outside of the post 102. A wall 203 of the post 102 is disposed between the two pins 218 such that lateral movement of the rail 104 into or out of the post 102 is restricted by the pins 218 making contact with the wall 203.

Due to the restricted movement of the rail 104 into or out of the post 102, when an object collides with the post 102, the post 102 absorbs at least some of the force of the impact using its impact absorption mechanism 208 and transfers at least some of the force of the impact to other posts 102 via the rails 104 connected to the post 102.

Impact Absorbing Pedestrian Barrier

Figure 3:
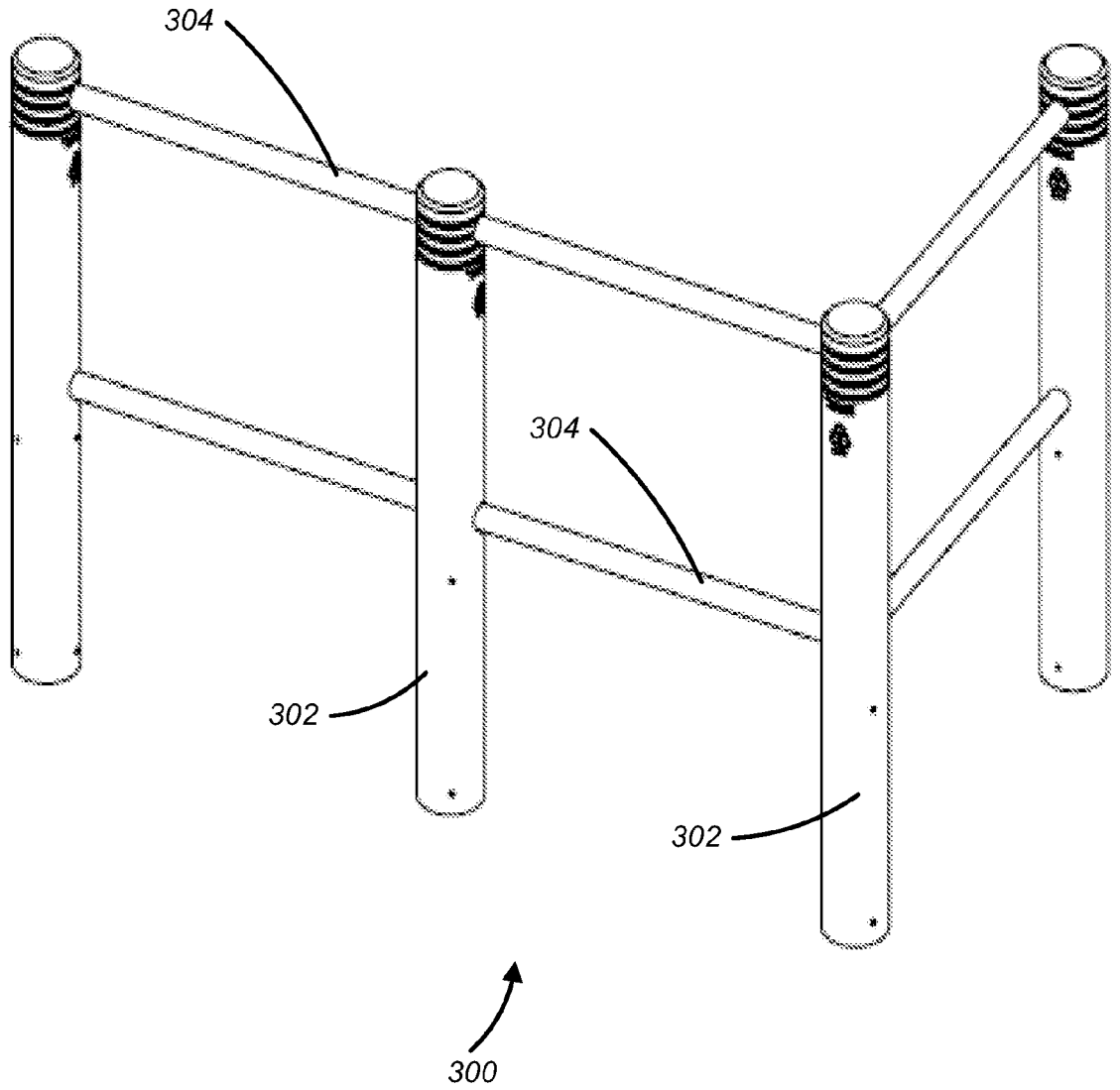
FIG. 3 is a first embodiment of an impact absorbing pedestrian walkway barrier.

Referring to FIG. 3, an impact absorbing pedestrian barrier 300 includes a number of impact absorbing posts 302 interconnected by rails 304. In some examples, the barrier 300 has a shape which conforms to a shape of a pedestrian walkway (not shown). The individual components of the barrier 300 work in much the same way as described above in relation to the impact absorbing column protection barrier. That is, the force of an object colliding with any one of the posts 302 or rails 304 is absorbed by the posts 302 and distributed among the posts 302 by the rails 304. It is noted that, in the embodiment shown in FIG. 3 none of the rails 304 extend entirely through a post 302.

Figure 4:
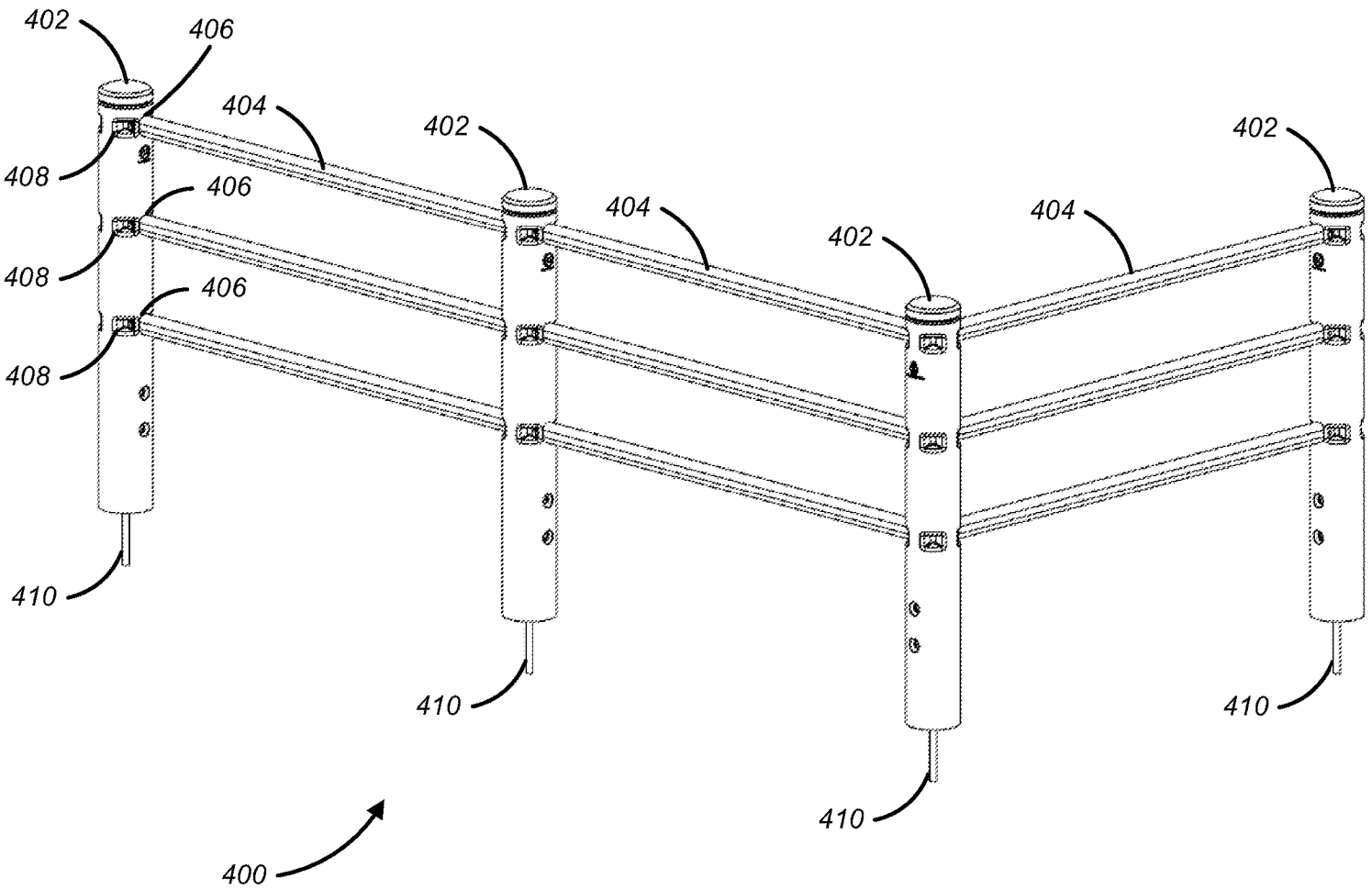
FIG. 4 is a second embodiment of an impact absorbing pedestrian walkway barrier.

Referring to FIG. 4, another embodiment of an impact absorbing pedestrian walkway barrier 400 includes a number of substantially cylindrical posts 402 linked together by a number of rails 404. In general, the barrier 400 is fixed to a surface (e.g., a warehouse floor) via fasteners 410 (e.g., bolts or pieces of rebar) at the bottom ends of the posts 402.

Each of the posts 402 includes one or more holes 406 into which the ends of the rails 404 are inserted. A recess 408 (e.g., a substantially triangularly shaped indentation) is disposed on each side of each of the holes 406. The recesses 408 on either side of a given hole 406 protrude into a hollow space inside of each post 402 and define a hollow channel inside of the post 406, the hollow channel extending into the post 408 from the given hole 406. During installation, the rail 404 is inserted into the hollow channel via the hole 406. A fastener (e.g., a pin, screw, or bolt) extends through a wall of the post 402 in a recess 408 on a first side of the hole 406, through the rail 404, and through the wall of the post 402 in a recess on a second side of the hole 406, thereby securing the rail 404 in the post 402.

In some examples, an inner diameter of each of the holes 406 is slightly larger than an outer diameter of the rails 404 such that the pedestrian walkway barrier 400 can be installed onto imperfect (e.g., not level) surfaces.

In some examples, the posts 402 are installed at a predefined distance from one another (e.g., 5 feet apart) and the rails 404 are fabricated to be slightly longer than the predefined distance. In some examples, the length of the rails 404 is specified such that, when a rail is inserted into but not fastened to two installed posts 402, one end of the rail 404 can be slid as far as possible into the hole in one of the two posts 402, causing the other end of the rail 404 to emerge from the hole in the other of the two posts 402. This property of the rails 404 simplifies rail installation and replacement.

In some examples, the tops of the posts 402 are non-removable and are shaped such that they shed water and debris. In some examples, the tops of the posts 402 have a convex shape.

In some examples, any areas of the pedestrian walkway barrier 400 where hardware (e.g. fasteners) is installed are recessed to ensure that people and/or equipment do not snag or catch on the hardware. In some examples, the recesses are left open to the environment to ensure that installation, un-installation, and reconfiguration of the pedestrian walkway barrier 400 is easily and obviously accomplished.

Figure 5:
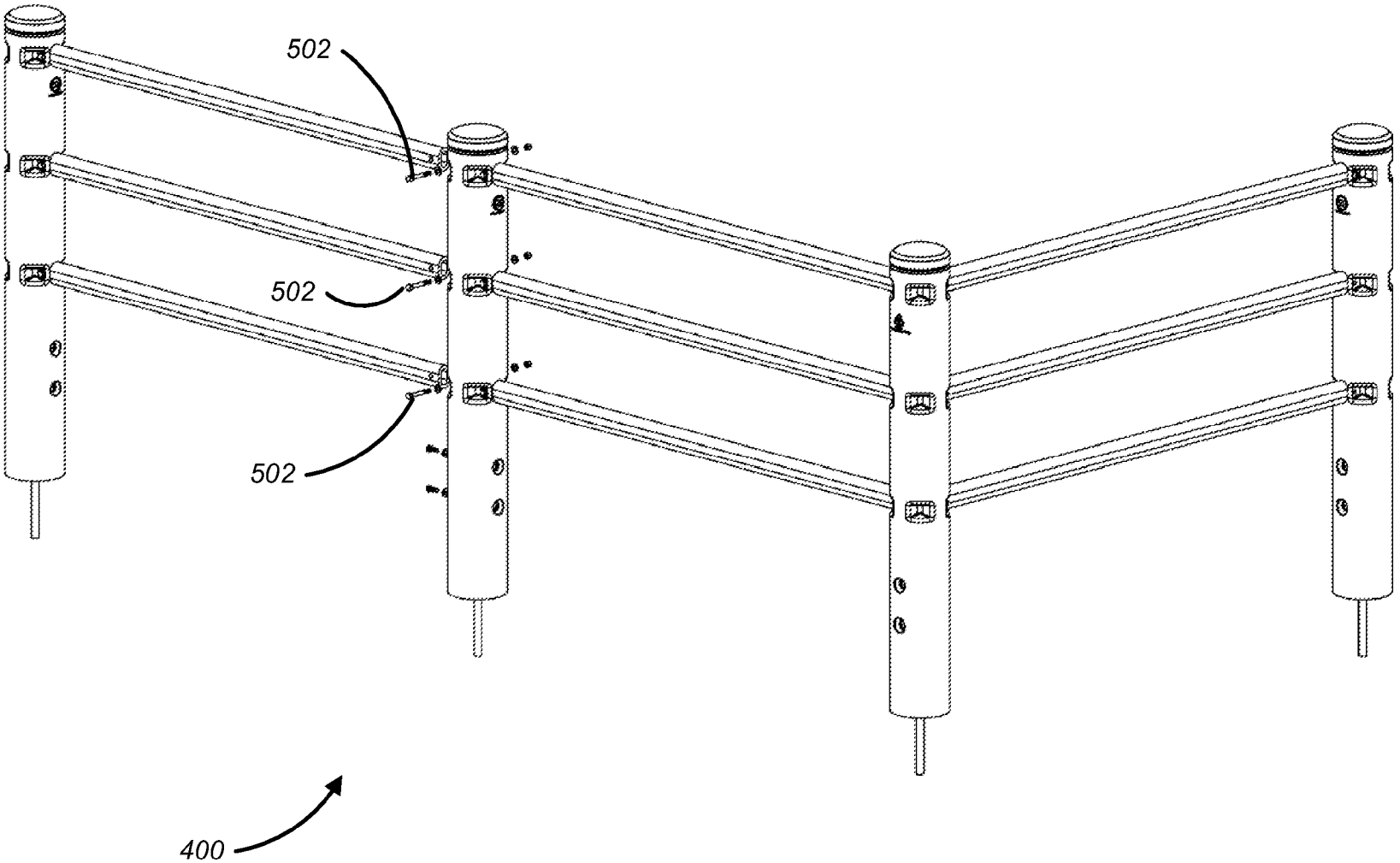
FIG. 5 is a partially exploded view of the pedestrian walkway barrier of FIG. 4.

Referring to FIG. 5, certain of the rails 404 of the pedestrian walkway barrier 400 are shown un-fastened and removed from the holes in one of the posts 402. It is evident in FIG. 5 that the rail 404 can be inserted into the hollow channel via the hole 406. A fastener 502 (e.g., a pin, screw, or bolt) can then be inserted through a wall of the post 402 in a recess 408 on a first side of the hole 406, through the rail 404, and through the wall of the post 402 in a recess on a second side of the hole 406, thereby securing the rail 404 in the post 402.

Figure 6:
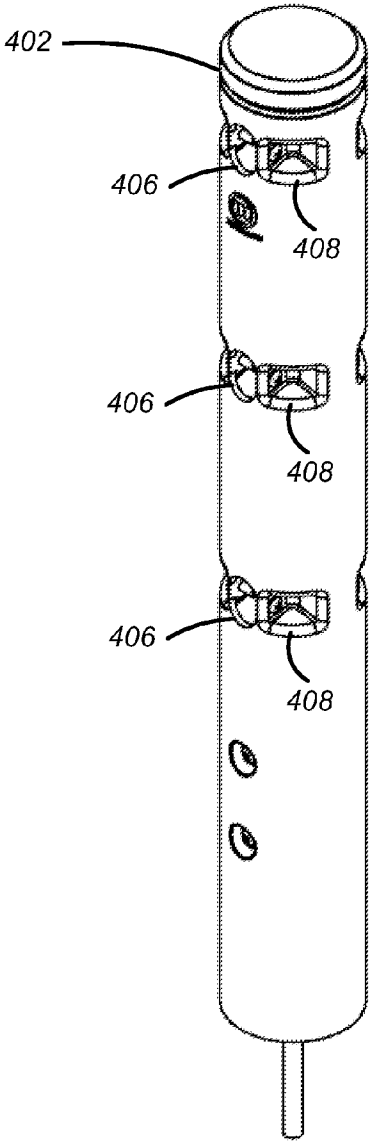
FIG. 6 is a pedestrian walkway barrier post.
Figure 7:
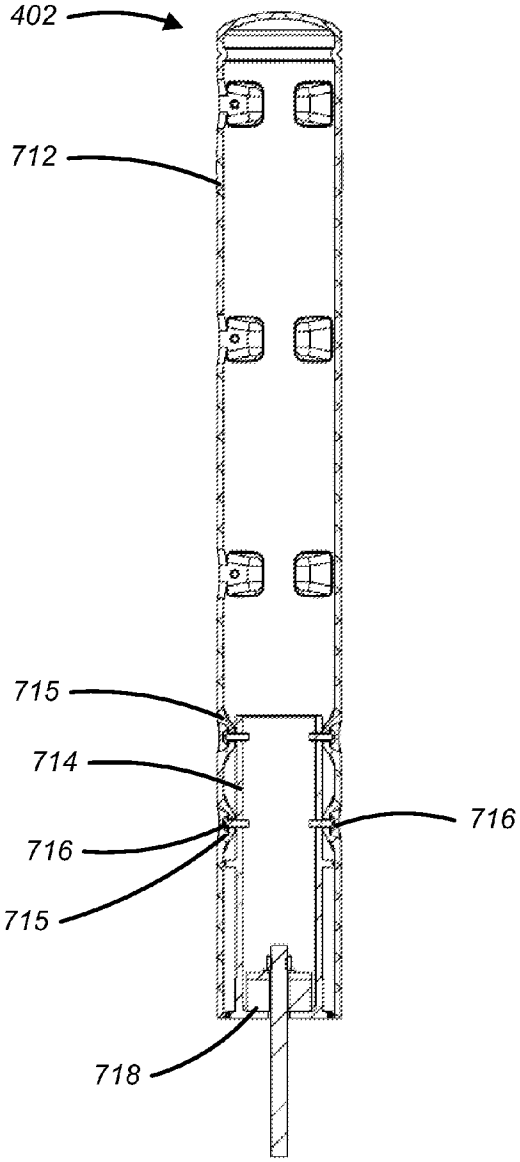
FIG. 7 is a cross-sectional view of the pedestrian walkway barrier post of FIG. 6.

Referring to FIG. 6, a detailed view of a pedestrian walkway barrier post 402 shows a number of holes 406, each having a recess 408 on its two sides. Referring to FIG. 7, a cross-sectional view of a pedestrian walkway barrier post 402 includes an outer shell 712 and an inner core 714. In some examples, the outer shell 712 and the inner core 714 are fastened to one another using screws 716 which extend through both the outer shell 712 and the inner core 714. In some examples, the screws 716 securely attach the outer shell 712 to the inner core 714.

As was noted above, in some examples, the outer shell 712 includes recesses 715 in any area where the screws 716 extend through the outer shell 712. The recesses ensure that people and/or equipment do not snag or catch on the hardware. In some examples, the recesses are left open to the environment to ensure that installation, un-installation, and reconfiguration of the pedestrian walkway barrier 400 is easily and obviously accomplished.

In some examples the outer shell 712 is made of a plastic material (e.g., high density polyethylene (HDPE)) and the inner core 714 is made of a metallic material (e.g., stainless steel).

In some examples, the inner core 714 includes a shock absorption mechanism 718 for allowing the post 402 to non-destructively absorb the force of a collision (e.g., with stock handling machinery). One example of such a shock absorption mechanism 718 is described in U.S. Pat. No. 8,444,343, issued on May 21, 2013 and titled "Impact Absorbing Anchoring Assembly for Protective Barrier."

Figure 8:
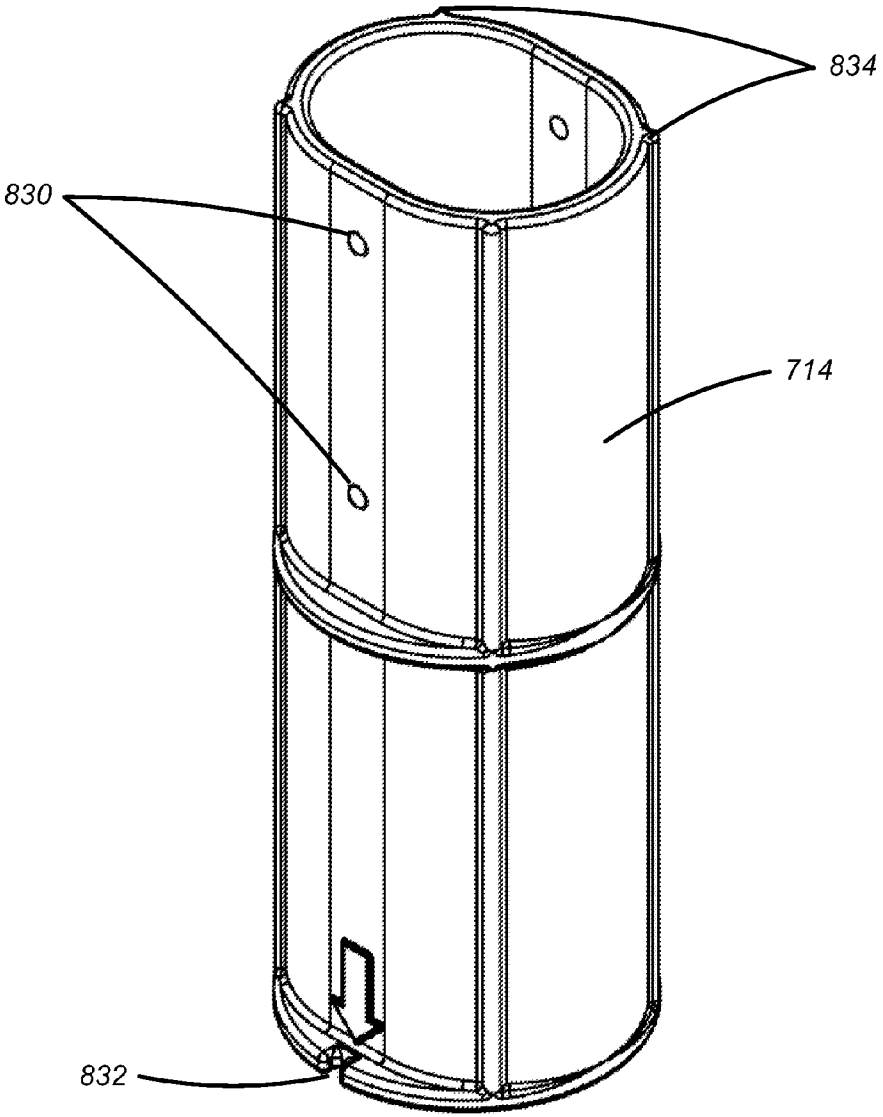
FIG. 8 is a pedestrian walkway barrier post inner core.

Referring to FIG. 8, in some examples, the inner core 714 has a substantially oval shape and includes a number of through holes 830, a number of vertical ribs 834, one or more horizontal ribs 836, and a visual alignment aid 832.

In general, the substantially oval shape of the inner core 714 provides the inner core 714 with increased strength in a direction of the largest diameter of the inner core 714. In some examples, the oval shape also facilitates a proper alignment of the outer shell 712 onto the inner core 714 during installation of the pedestrian walkway barrier 400. In some examples, each of the through holes 830 receives one of the fasteners 716 for securing the outer shell 712 to the inner core 714. In some examples, the through holes 716 are not present and the outer shell 712 is free to rotate about the inner core 714.

In some examples, each of the vertical ribs 834 is configured to make contact with an inner surface of the outer shell 712 when it is installed to ensure a secure fit of the outer shell 712 on the inner core 714. In some examples, the vertical ribs 834 also provide areas of increased material thickness on the inner core 714, providing additional strength to the inner core 714. Similarly, the horizontal rib 836 is configured to make contact with an inner surface of the outer shell 712 when it is installed to ensure a secure fit of the outer shell 712 on the inner core 714. The horizontal rib 836 also provides an area of increased material thickness on the inner core 714, providing additional strength to the inner core 714.

In some examples, the visual alignment aid 832 provides an installation technician with a way of knowing in which orientation to install the inner core 714 on the ground. For example, the technician could draw a straight line and then ensure that all of the visual alignment aids 832 of a number of inner cores 714 of a pedestrian walkway barrier system are aligned with that straight line. Doing so helps to simplify installation and to ensure that the holes in the posts are aligned when the time comes to install the rails. In some examples, the visual alignment aids 832 also ensure that the inner cores 714 are aligned such that a head-on collision with an inner core 714 applies force along a line extending through a widest portion of the inner core 714.

Figure 9:
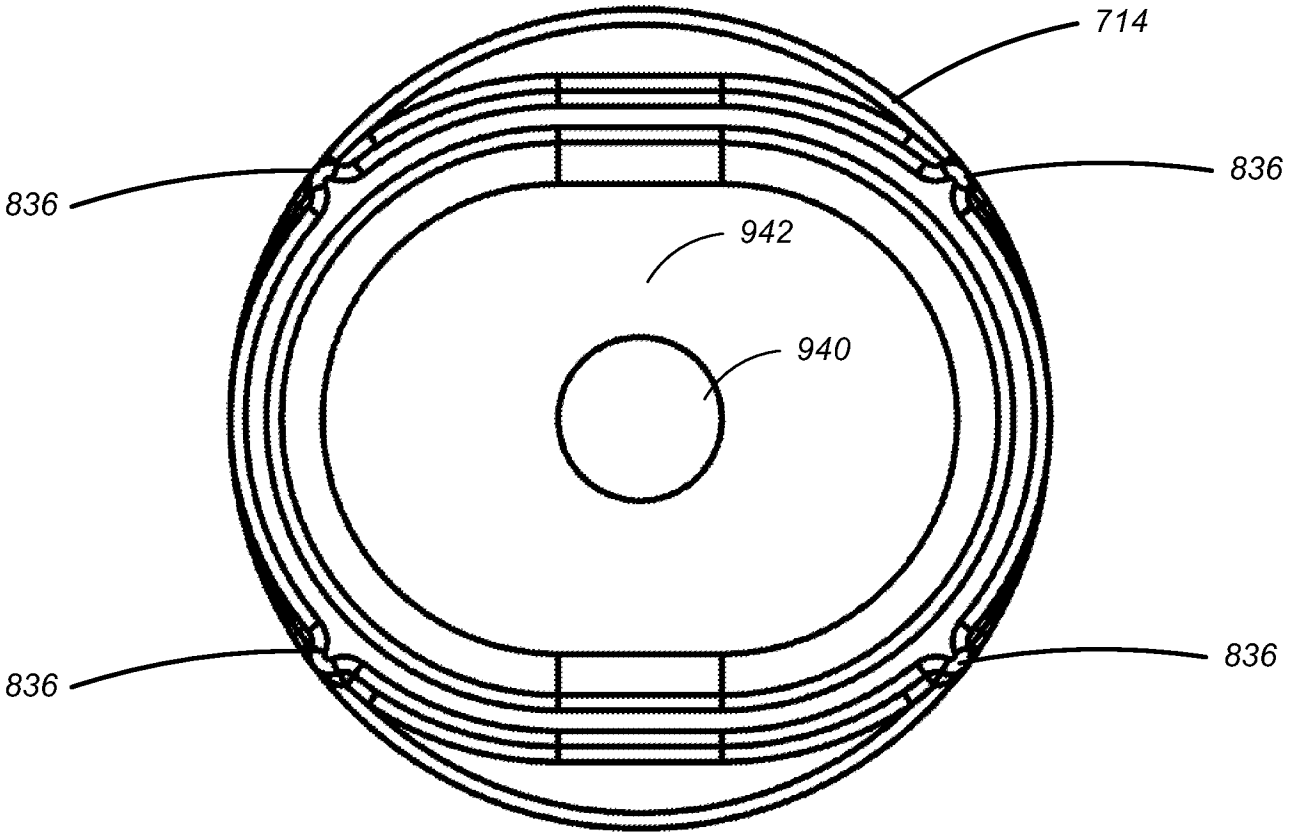
FIG. 9 is a top view of the pedestrian walkway barrier post inner core of FIG. 8.

Referring to FIG. 9, in some examples, the inner core 714 includes a through hole 940 in its bottom surface 942. In general, the through hole 940 allows for the inner core 714 to be attached to a surface using, for example, a bolt or a piece of rebar that is part of a shock absorbing mechanism 718. FIG. 9 also provides another view of the vertical ribs 834 and the horizontal rib 836.

Figure 10:
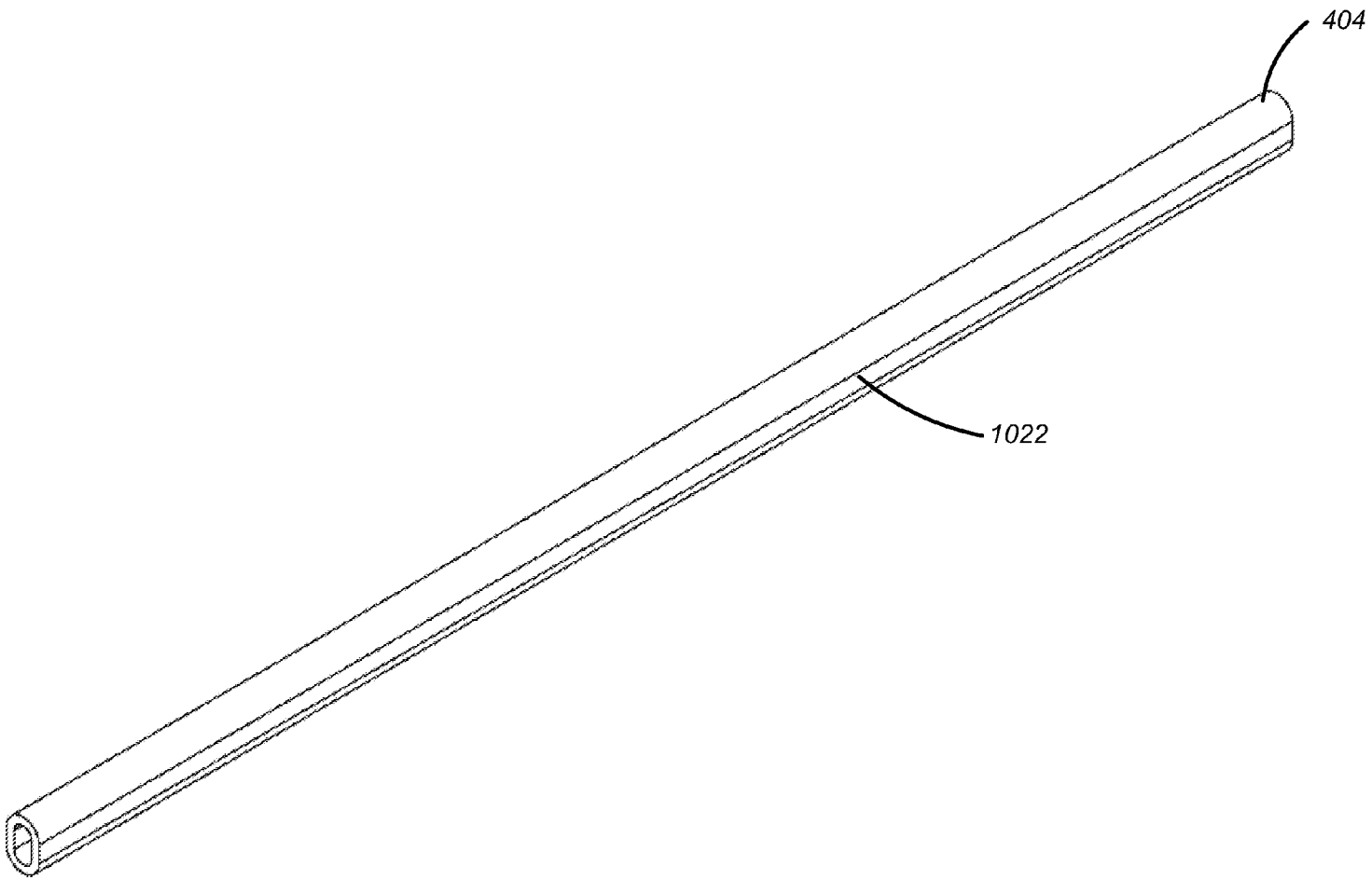
FIG. 10 is a pedestrian walkway barrier rail.

Referring to FIG. 10, in some examples the pedestrian walkway barrier rail 404 has a substantially oval shape. In some examples, the rail is installed such that a broadest side 1022 of the rail 404 absorbs any collisions from stock handling equipment.

In some examples, the rail 404 includes pre-drilled holes (not shown) for receiving fasteners. In other examples, no holes are included in the rails and holes are drilled in the rails 104 at the time of installation, ensuring a proper hole placement. In some examples, a jig is provided to ensure that the holes are drilled in such a way that they line up with holes in the recesses 408 of the posts 402.

In some examples, the rails 404 are made from a plastic material such as HDPE. In some examples, the rails 404 are resilient and return to their original shape and position after being struck by an object. In some examples, the rails 404 are hollow. In other examples, the rails 404 are made of a solid material. In general, any number of rails 404 greater than one can be used to connect any two posts in the pedestrian walkway barrier 400.

In some examples, the pedestrian walkway barrier 400 can be installed at various angles (e.g., the barrier may include a 30 degree angle). In some examples, the pedestrian walkway barrier may include a curved section (e.g., including curved rails 404).

Figure 11:
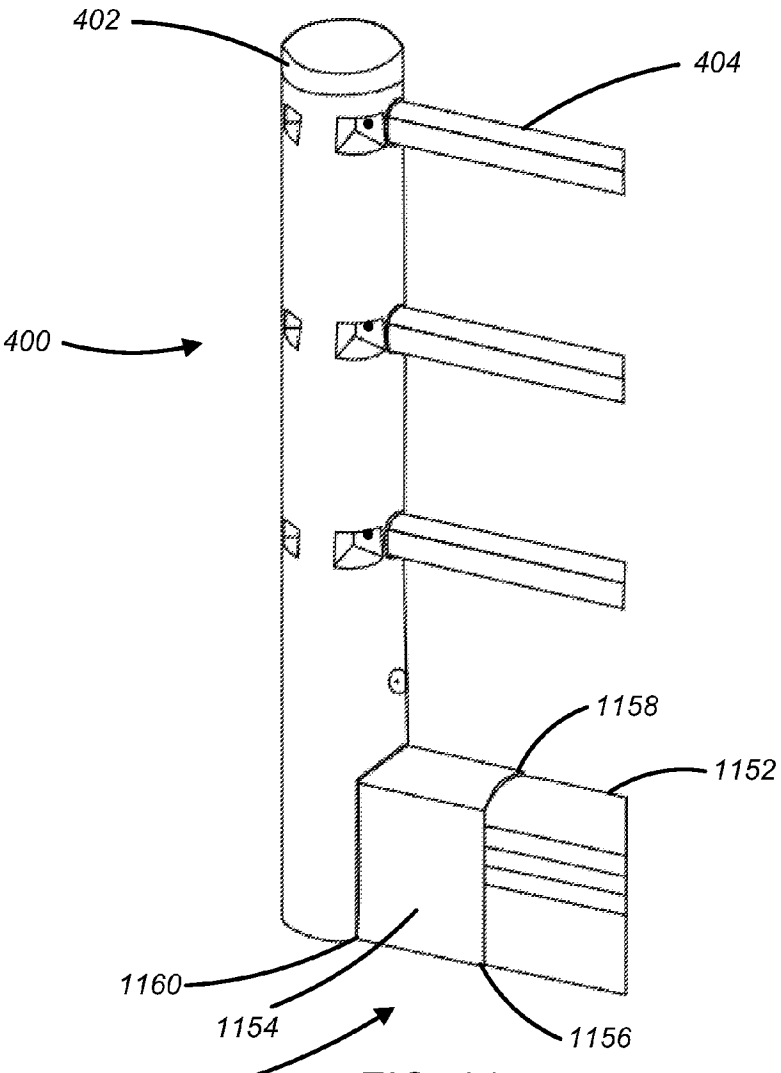
FIG. 11 is a section of a pedestrian walkway barrier including a surface level crash barrier.

Referring to FIG. 11, in some examples, the pedestrian walkway barrier 400 includes an integrated crash barrier 1150 which abuts and extends between the bottom ends two or more of the posts 402. In some examples, the crash barrier 1150 is similar in design to the barriers described in co-pending U.S. patent application Ser. No. 14/658,777 (Attorney Docket No. 40039-111001).

In some examples, each end of the crash barrier 1150 includes a shock absorbing rail 1152 and a metallic end cap 1154. In some examples, the metallic end cap 1154 is affixed to a surface (e.g., a warehouse floor) and an end of the shock absorbing rail 1152 is held in place by the metallic end cap 1154. To hold the shock absorbing rail 115 in place, a first end 1156 of the metallic end cap 1154 has an opening 1158 for receiving the end of the shock absorbing rail 1152. A second end 1160 of the metallic end cap 1154 has a concave shape which conforms to an outer surface of the post 402 that it abuts. In this way, the crash barrier 1150 extends between the bottom ends of two posts 402 of the pedestrian walkway barrier 400, leaving little to no space for objects (e.g., the forks of a fork truck) to cross between the posts of the pedestrian walkway barrier and into a pedestrian walkway.

Figure 12:
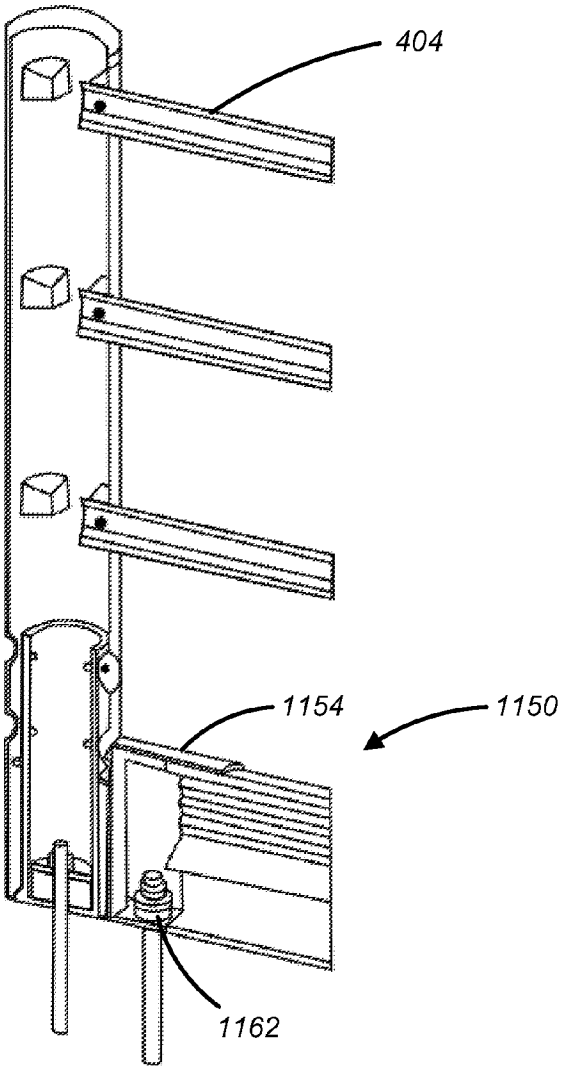
FIG. 12 is a cross-sectional view of the section of the pedestrian walkway barrier of FIG. 11.

Referring to FIG. 12, in some examples, the metallic end cap 1154 of the crash barrier 1150 is fastened to a surface using a shock absorption mechanism 1162. One example of such a shock absorption mechanism is described in U.S. Pat. No. 8,444,343, issued on May 21, 2013 and titled "Impact Absorbing Anchoring Assembly for Protective Barrier."

In some examples, the pedestrian walkway barrier may include a gate. In some examples the pedestrian walkway barrier may include a retractable gate belt.

Figure 13:
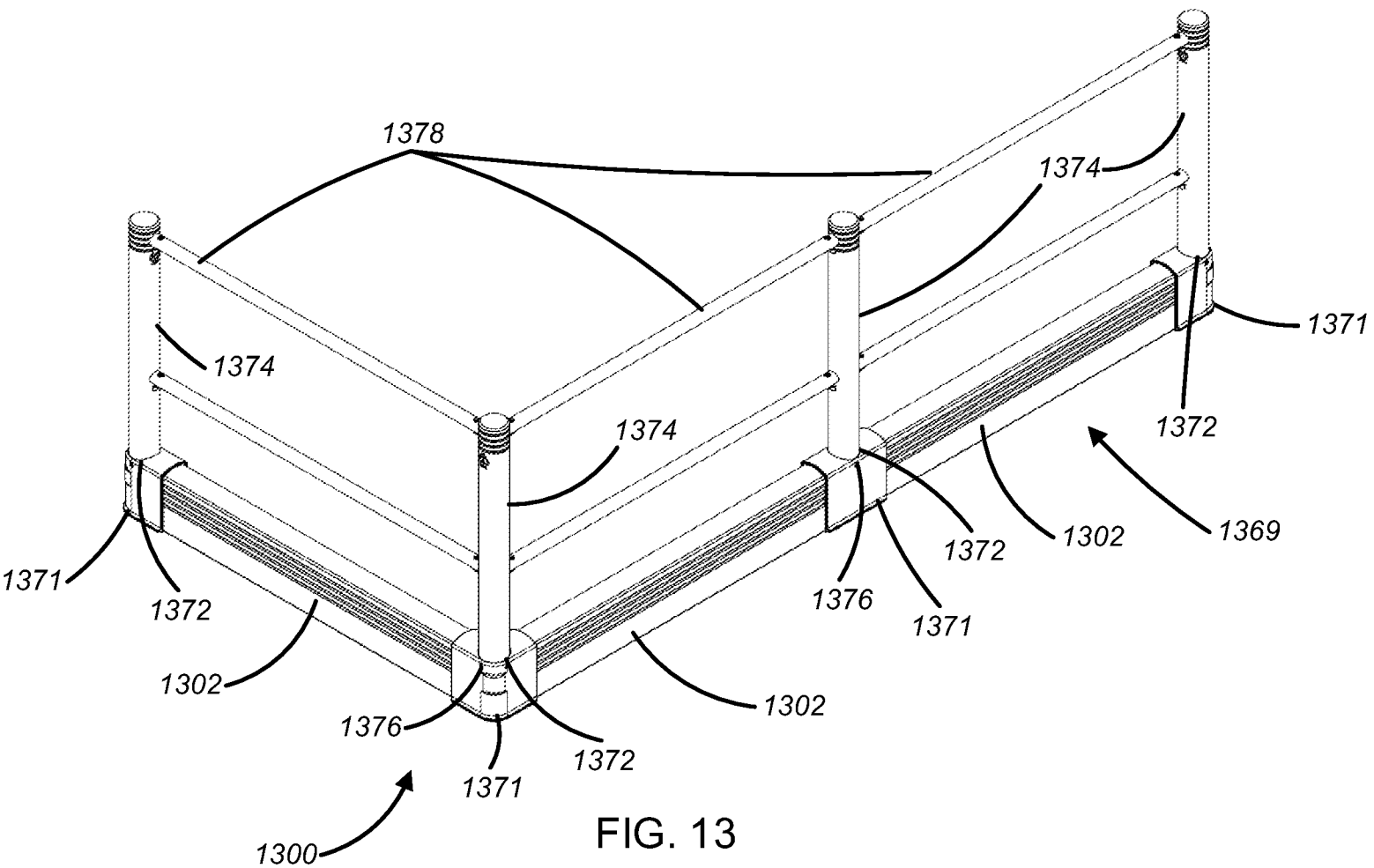
FIG. 13 is a third embodiment of a pedestrian walkway barrier.

Referring to FIG. 13, another embodiment of a impact absorbing pedestrian walkway barrier 1300 is configured to protect pedestrians on a pedestrian walkway (not shown) from unintended collisions with stock handling equipment. The pedestrian walkway barrier 1300 includes a crash barrier 1369 including a number of plastic bumper rails 1302 coupled to one another using various metallic connectors and end caps 1371.

Each of the metallic connectors and end caps 1371 has a circular hole 1272 in its top surface, into which a post 1374 is inserted. In some examples, an inside surface of the metallic connectors and end caps 1371 includes ribs (not shown) which help to ensure a tight fit of the posts 1374 in the holes 1372. In some examples, the posts 1374 are further secured in the holes by fasteners 1376 (e.g. screws or pins).

Pairs of the posts 1374 are interconnected by rails 1378, resulting in a fence-like structure for protecting the pedestrian walkway. In some examples, the rails 1378 are affixed to the posts using a releasable connection (e.g., a spring-loaded pin or clip). In other examples, the rails 1378 are rigidly affixed to the posts 1374 (e.g., using a connection such as that shown in FIG. 4).

As was the case with the pedestrian walkway barrier of FIGS. 11 and 12, the crash barrier 1369 prevents stock handling equipment from accidentally encroaching on the pedestrian walkway and the pedestrian walkway barrier 1300 as a whole prevents pedestrians from accidentally moving off of the pedestrian walkway and possibly into the path of stock handling equipment.

Sand Cast Components

In some examples, the various metallic parts described above (e.g., the metallic end caps and connectors used in the crash barriers) can be fabricated using a sand casting process. Very generally, sand casting is a metal casting process that uses sand as the mold material. Due to the versatility of sand as a mold material, the metallic end caps and connectors can be cast with features (e.g., varied shapes and wall thicknesses) that would be difficult or impossible to achieve using other metal fabrication techniques (e.g., roll-forming). Furthermore, sand casting of a metallic end cap or connectors, including the features, can be accomplished in a single step, yielding a metallic end cap or connector that integrally includes the features. In general, such integrally formed features are stronger than features which are, for example, welded onto a previously fabricated piece.

Figure 14:
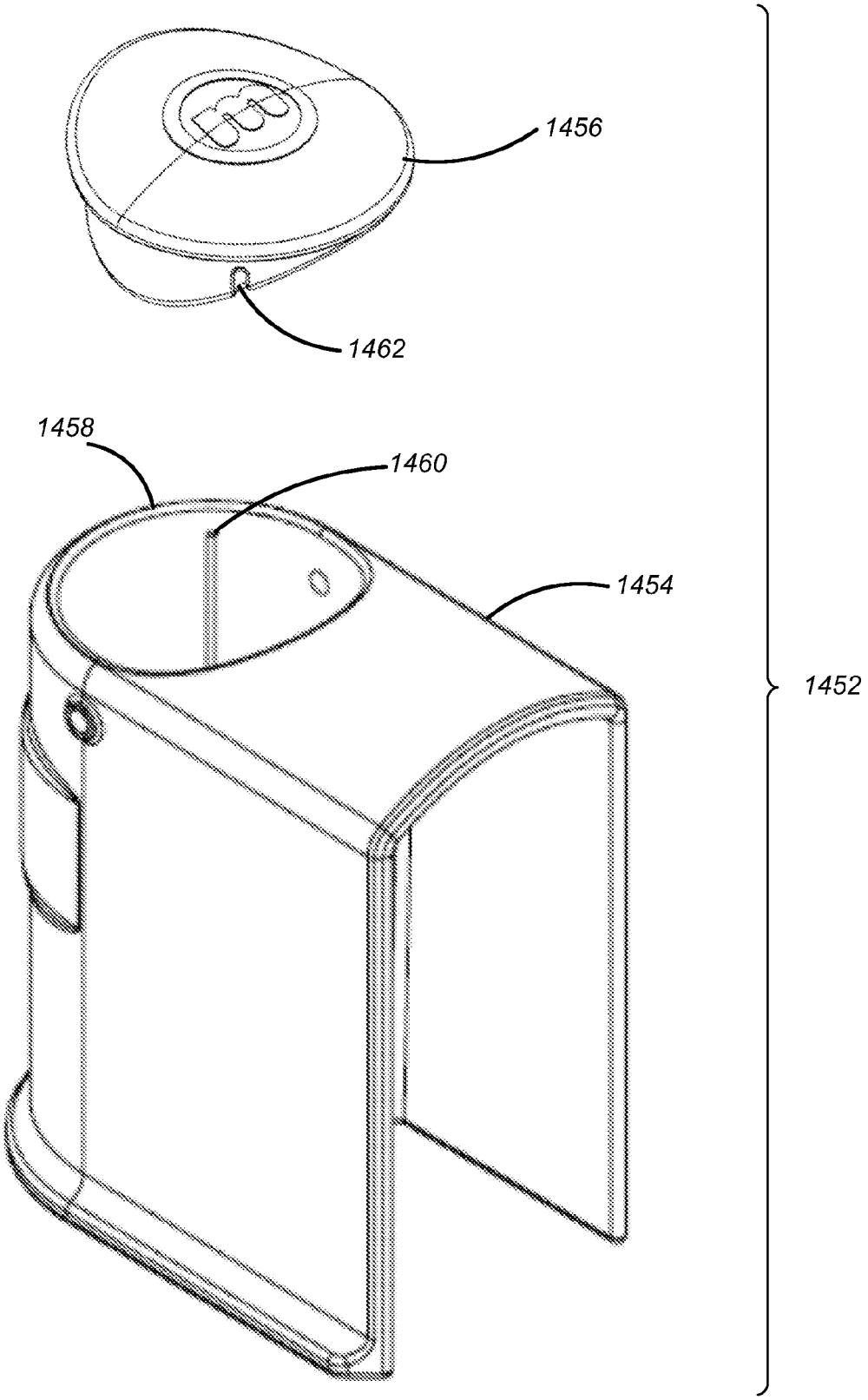
FIG. 14 is a perspective view of a second sand cast rounded metallic end cap.

Referring to FIG. 14, an embodiment of a rounded metallic end cap 1452 for use in, for example, the pedestrian walkway barrier 1300 of FIG. 13 includes a sand cast body 1454 and a sand cast lid 1456. When fully assembled, the sand cast lid 1456 is inserted into a top opening 1458 in the sand cast body 1454. Both the sand cast body 1454 and the sand cast lid 1456 include a number of features that are made possible by using the sand casting fabrication process.

In some examples, the sand cast body 1454 includes a number of ribs 1460 disposed inside of the top opening 1458. The ribs 1460 have two uses. In the first use, the ribs 460 are inserted into corresponding grooves 1462 in the sand cast lid 1456 for the purpose of aligning the sand cast lid 1456 into a desired position in the top opening 1458. In the second use, the ribs 1460 make contact with a post (as shown in FIG. 13) that is inserted into the top opening 1458 to ensure a tight, toleranced fit between the sand cast body 1454 and the post.

Figure 15A:
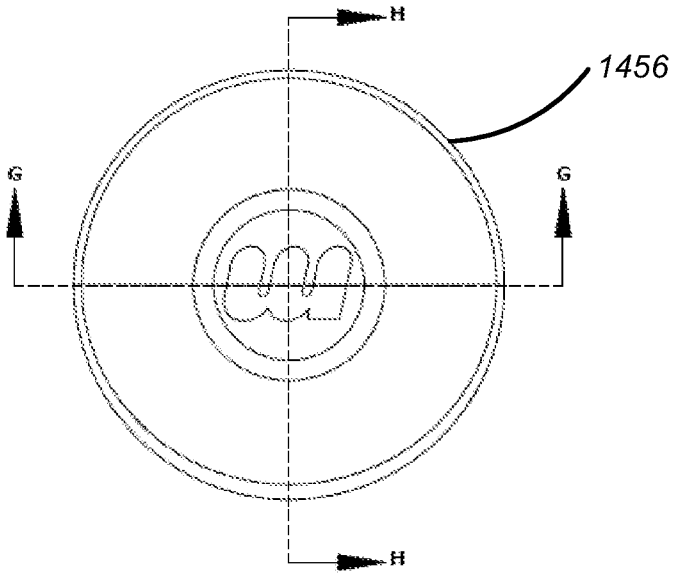
FIG. 15A-FIG. 15C are views of a second sand cast lid.
Figure 15B:
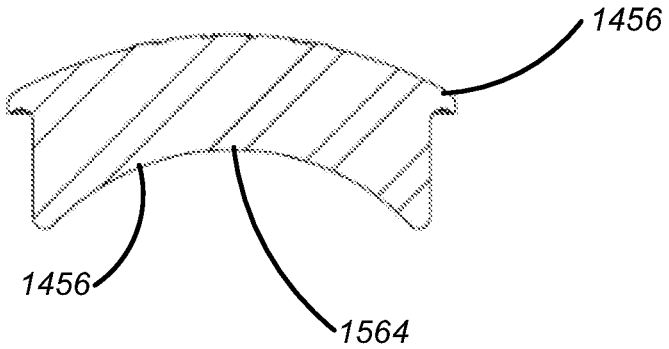

Referring to FIG. 15A, a top view of the sand cast lid 1456 includes two cross-sectional lines, an H-H cross-sectional line and a G-G cross-sectional line. Referring to FIG. 15B, a view taken along the G-G cross-sectional line of FIG. 15*a* shows a curved rib 1564 extending along the G-G cross-sectional line. The curved rib 1564 is integrally formed with the sand cast lid 1456 and both minimizes material use and optimizes the strength of the sand cast lid 1456. When the sand cast lid 1456 is inserted into the top opening 1458 of the sand cast body 1454, the curved rib 1564 also receives and distributes the force of impact (e.g., by stock handling equipment) on the sand cast body.

Figure 15C:
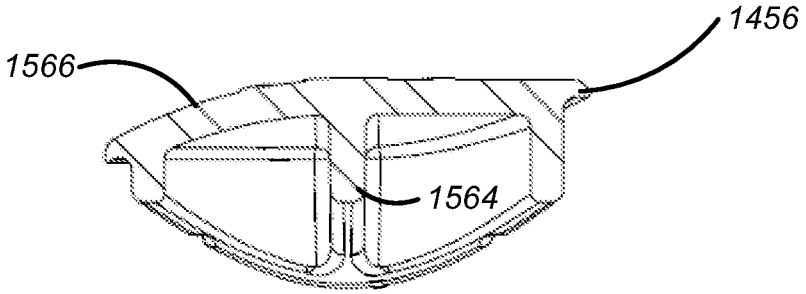

Referring to FIG. 15C, a view taken along the H-H cross-sectional line shows that, in some examples, a top surface 1566 of the sand cast lid 1456 has a complex, curved shape with a uniform wall thickness.

Figure 16:
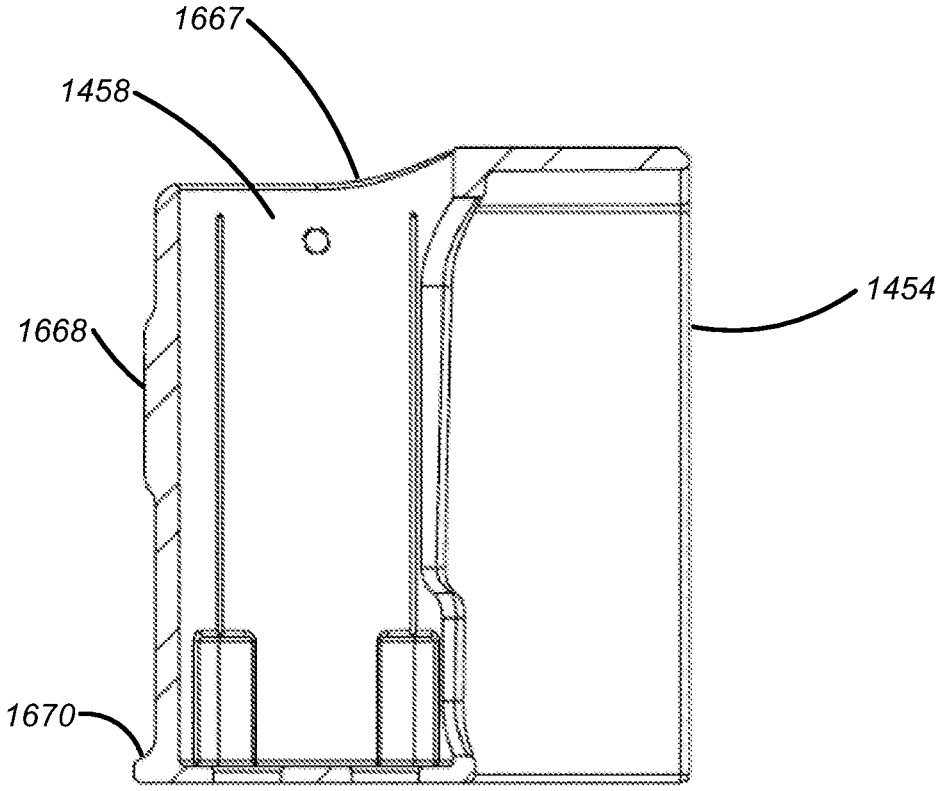
FIG. 16 is a cross-sectional view of a second sand cast body.

Referring to FIG. 16, a cross-sectional side-view of the sand cast body 1454 shows that, in some examples, the sand cast body 1454 includes an area of increased wall thickness 1668, a flange 1670, and a top surface 1667 with a complex curvature.

In some examples, the area of increased wall thickness 1668 is located on a portion of the sand cast body 1454 that is likely to be struck (e.g., by stock handling equipment). The increased thickness of the wall resists damage to the wall in the event that the sand cast body 1454 is struck. The flange 1670 is formed integrally with the sand cast body 1454, reduces stress on the sand cast body 1454 in the event of an impact, and prevents damage to a surface (e.g., concrete) onto which the sand cast body 1454 is mounted in the event that the sand cast body 1454 is struck.

In some examples, the complex curvature of the top surface 1767 of the sand cast body 1454 provides an aesthetic effect. The sand casting process allows for the top opening 1458 to extend through the complex curvature of the top surface 1667 while preserving a desired (e.g., circular shape) when the sand cast body 1454 is viewed from the top.

Alternatives

In some examples, the posts described above are formed from a high density polyethylene material (HDPE) and the rails are formed from extruded metallic pipe. In some examples, the HDPE material is colored using a high visibility color (e.g. yellow). In some examples, the rails are painted using paint with a high visibility color (e.g. yellow). In other examples, the rails are made from an HDPE material.

Many barrier configurations other than the two embodiments described above are possible using the component parts (i.e., impact absorbing posts and rails) described above.

In some examples, an epoxy resin is used to fix the anchoring mechanism of the posts into the ground.

It is to be understood that the foregoing description is intended to illustrate and not to limit the scope of the invention, which is defined by the scope of the appended claims. Other embodiments are within the scope of the following claims.

What is claimed is:

1. An impact absorbing barrier comprising:

a plurality of posts, each post of the plurality of posts including an outer shell with an inner core inserted therein, the outer shell including:

a plurality of first recesses and a plurality of second recesses; and a plurality of holes, each hole of the plurality of holes opening into an associated channel within the post and corresponding to one of the plurality of first recesses disposed in the outer shell on a first side of the hole and corresponding to one of the plurality of second recesses disposed in the outer shell on a second side of the hole, the one of the plurality of first recesses and the one of the plurality of second recesses defining the associated channel; and a plurality of rails, each rail of the plurality of rails including:

a first end inserted into a corresponding first hole in the outer shell of a first post of the plurality of posts and into the channel associated with the first hole in the outer shell of the first post, the first end being coupled to the first post, and a second end inserted into a corresponding second hole in the outer shell of a second post of the plurality of posts and into the channel associated with the second hole in the outer shell of the second post, the second end being coupled to the second post.

2. The impact absorbing barrier of claim 1 wherein for at least some rails of the plurality of rails, the coupling between the first end of the rail and the first post includes a fastener inserted through a first through hole in a wall of the outer shell of the first post in the one of the plurality of first recesses corresponding to the first hole in the outer shell of the first post, through a second through hole in the first end of the rail disposed in the channel associated with the first hole in the outer shell of the first post, and through a third through hole in the wall of the outer shell of the first post in the one of the plurality of second recesses corresponding to the first hole in the outer shell of the first post.

3. The impact absorbing barrier of claim 2 wherein the fastener is arranged in the one of the plurality of first recesses corresponding to the first hole and the one of the plurality of second recesses corresponding to the first hole such that no part of the fastener extends from the recesses beyond an outer diameter of the outer shell.

4. The impact absorbing barrier of claim 1 wherein at least some posts of the plurality of posts further comprise an impact absorption mechanism.

5. The impact absorbing barrier of claim 4 wherein the inner cores of the at least some posts are hollow and the impact absorption mechanisms of the at least some posts are disposed within the hollow inner core.

6. The impact absorbing barrier of claim 1 wherein the outer shells of at least some posts of the plurality of posts are rigidly affixed to the inner core.

7. The impact absorbing barrier of claim 1 wherein the outer shells of at least some posts of the plurality of posts are rotatably affixed to the inner cores of the at least some posts.

8. The impact absorbing barrier of claim 1 wherein the inner cores of at least some posts of the plurality of posts have an oval shape.

9. The impact absorbing barrier of claim 8 wherein the inner cores of at least some posts of the plurality of posts include an alignment indicator for ensuring that the inner cores are installed in proper alignment with other inner cores of the barrier.

10. The impact absorbing barrier of claim 1 wherein the inner cores of at least some posts of the plurality of posts include one or more ribs for contacting inner surfaces of the outer shells of the at least some posts.

11. The impact absorbing barrier of claim 1 wherein at least some rails of the plurality of rails have a substantially oval shape.

12. The impact absorbing barrier of claim 1 wherein at least some rails of the plurality of rails are made of a plastic material.

13. The impact absorbing barrier of claim 1 wherein at least some rails of the plurality of rails are made of a metallic material.

14. The impact absorbing barrier of claim 1 wherein at least some rails of the plurality of rails are sized such that they extend between only two posts of the plurality of posts and do not extend fully through any post of the plurality of posts.

15. The impact absorbing barrier of claim 1 wherein at least some rails of the plurality of rails are sized such that they are removable from the impact absorbing barrier without requiring movement of any posts of the plurality of posts.

16. The impact absorbing barrier of claim 15 wherein a first rail of the plurality of rails is sized such that it is removable from the impact absorbing barrier by decoupling the ends of the rail from two posts of the plurality of posts and sliding a first end of the rail further into a first post of the two posts, causing a second end of the rail to emerge from a second post of the two posts.

17. The impact absorbing barrier of claim 1 further comprising one or more surface level barriers, each surface level barrier extending between respective bottom ends of two posts of the plurality of posts.

18. The impact absorbing barrier of claim 17 wherein each surface level barrier of the one or more surface level barriers includes two metallic end caps and a plastic rail extending between the two metallic end caps.

19. The impact absorbing barrier of claim 18 wherein each of the two metallic end caps is formed as a single integral piece using a sand casting process.

20. The impact absorbing barrier of claim 18 wherein, for at least some surface level barriers of the one or more surface level barriers, each metallic end cap of the two metallic end caps includes an impact absorption mechanism.

21. The impact absorbing barrier of claim 18 wherein, for at least some surface level barriers of the one or more surface level barriers, each of the metallic end caps abuts a bottom end of a post of the plurality of posts and has a shape that conforms to an outer surface of the bottom end of the post.

* * * * *